United States Patent [19]

Kovacs

[11] Patent Number: 4,692,957

[45] Date of Patent: Sep. 15, 1987

[54] BEND FOLLOWING PLUMBERS SNAKE

[76] Inventor: Julius S. Kovacs, 40 Canterberry Rd., Bridgeport, Conn. 06608

[21] Appl. No.: 839,204

[22] Filed: Mar. 13, 1986

[51] Int. Cl.[4] ..... B08B 9/02

[52] U.S. Cl. ..... 15/104.3 SN; 254/134.3 FT

[58] Field of Search ..... 15/104.3 SN, 257 R; 254/134.3 FT

[56] References Cited

U.S. PATENT DOCUMENTS

| | | | |
|---|---|---|---|
| 1,523,170 | 1/1925 | Cornelius | 15/104.3 SN |
| 1,653,002 | 12/1927 | Coleman | 15/104.3 SN |
| 1,783,256 | 12/1930 | Miller | 15/104.3 SN |
| 1,817,015 | 8/1931 | Miller | 15/104.3 SN |
| 1,844,433 | 2/1932 | Markowitz | 15/104.3 SN |
| 1,858,509 | 5/1932 | Kjerulff | 15/104.3 SN |
| 1,915,679 | 6/1933 | La Motte | 15/104.3 SN |
| 1,978,957 | 10/1934 | Pardieck | 254/134.3 FT |
| 4,292,704 | 10/1981 | Joanis, Sr. | 15/104.3 SN |

FOREIGN PATENT DOCUMENTS

| | | | |
|---|---|---|---|
| 676492 | 12/1963 | Canada | 15/104.3 SN |

*Primary Examiner*—Edward L. Roberts

*Attorney, Agent, or Firm*—Arthur T. Fattibene

[57] ABSTRACT

A plumbers snake having a weighted end and jointed members attached to a flexible shaft at the leading end thereof for removing or clearing obstructions in pipes or conduits. The weighted end and jointed members are arranged so as to facilitate negotiating any sharp bends disposed in the pipe by the jointed members being hinged in different planes. Included is a hand grip which is slidably adjusted at the outer end of the snake, which, when squeezed, is frictionally secured to the snake, to provide for a greater longitudinal force being applied to the snake during an insertion or unclogging operation.

4 Claims, 5 Drawing Figures

BEND FOLLOWING PLUMBERS SNAKE

FIELD OF INVENTION

This invention relates generally to a plumbers snake used for dislodging obstructions in pipes and more specifically to a plumbers snake capable of negotiating around sharp bends in pipe.

PROBLEM AND PRIOR ART

The prior art plumbers snakes usually consist of a closely coiled spring or spiral of wire having a handle at one end and an open coil tip at the other end. The coiled spring or spiral of wire is flexible to accommodate small bends in the pipe that occur prior to the obstruction, but also must be stiff enough to be used successfully as a ramming tool when an obstruction is encountered. The neccessity for the plumbers snake to be flexible enough to negotiate around bends in pipe and yet be rigid enough to act as a ramming tool to dislodge obstructions created a difficult problem in the prior art. If the coiled spring or spiral of wire was made too flexible it would be difficult to guide down the pipe as well as be useless as a ramming tool. If the coiled spring or spiral of wire was made too rigid only the gentlest of bends in the pipe could be negotiated around. Another obstruction noted with plumber snakes is that due to the relatively small diameter of the flexible coil or snake, considerable difficulty would be encountered in snaking the plumber snake in a pipe or conduit. This problem is further aggreviated when an obstruction is reached. The noted difficulty results from the fact that it is difficult for the operator to grip the snake which sufficient force to longitudinally advance the same over any substantial distance. Known approaches to solve the noted problems can be found in U.S. Pat. No. 2,246,056 entitled "Sewer Opener" invented by L. G. McKenzie and U.S. Pat. No. 2,341,435 entitled "Plumber's Fishing Tool " invented by L. Gelea. The McKenzie patent discloses a flexible cable having a plurality of balls or beads mounted thereon. The balls or beads are mounted so that they can move longitudinally along the cable. After the flexible cable is inserted into the pipe and an obstruction is encountered, a toggle device secured to the outer end is used to force all the balls or beads together causing the cable to become stiff so that it may be used as a ramming tool. The Gelea patent discloses a chain having a grappling hook and light ball on one end. The chain is very flexible and not suitable as a ramming tool. Various other known sewer or plumber's snakes are disclosed in U.S. Pat. Nos. 2,275,850; 2,355,733; 3,064,293; 3,397,420; 3,694,011; 3,983,593; 4,232,419 and 4,292,704.

OBJECTS

It is an object of this invention to provide a plumbers snake capable of negotiating sharp bends in pipe.

It is another object to provide a plumber's snake with an slideably adjustable handle or grip to facilitate the insertion of the snake through a conduit.

It is another object of this invention to provide a plumber's snake capable of being used as a ramming tool to dislodge an obstruction in a pipe.

It is further object of this invention to provide a plumber's snake that is simple and easy to use.

SUMMARY OF INVENTION

These and other objectives are achieved by a plumber's snake made of an elongated flexible member, e.g. a spring or coil of wire having an improved weighted jointed member at the lead end of the flexible member that enters the pipe leading to the obstruction needing to be dislodged. The jointed member is constructed so as to be capable of working around sharp bends which may be located in the conduit or pipe to be unclogged. A slideably and adjustable handle or grip is provided on the trailing end of the snake to facilitate the insertion of the snake through a pipe or conduit.

DESCRIPTION OF THE PREFERRED EMBODIMENTS

Figure 1:
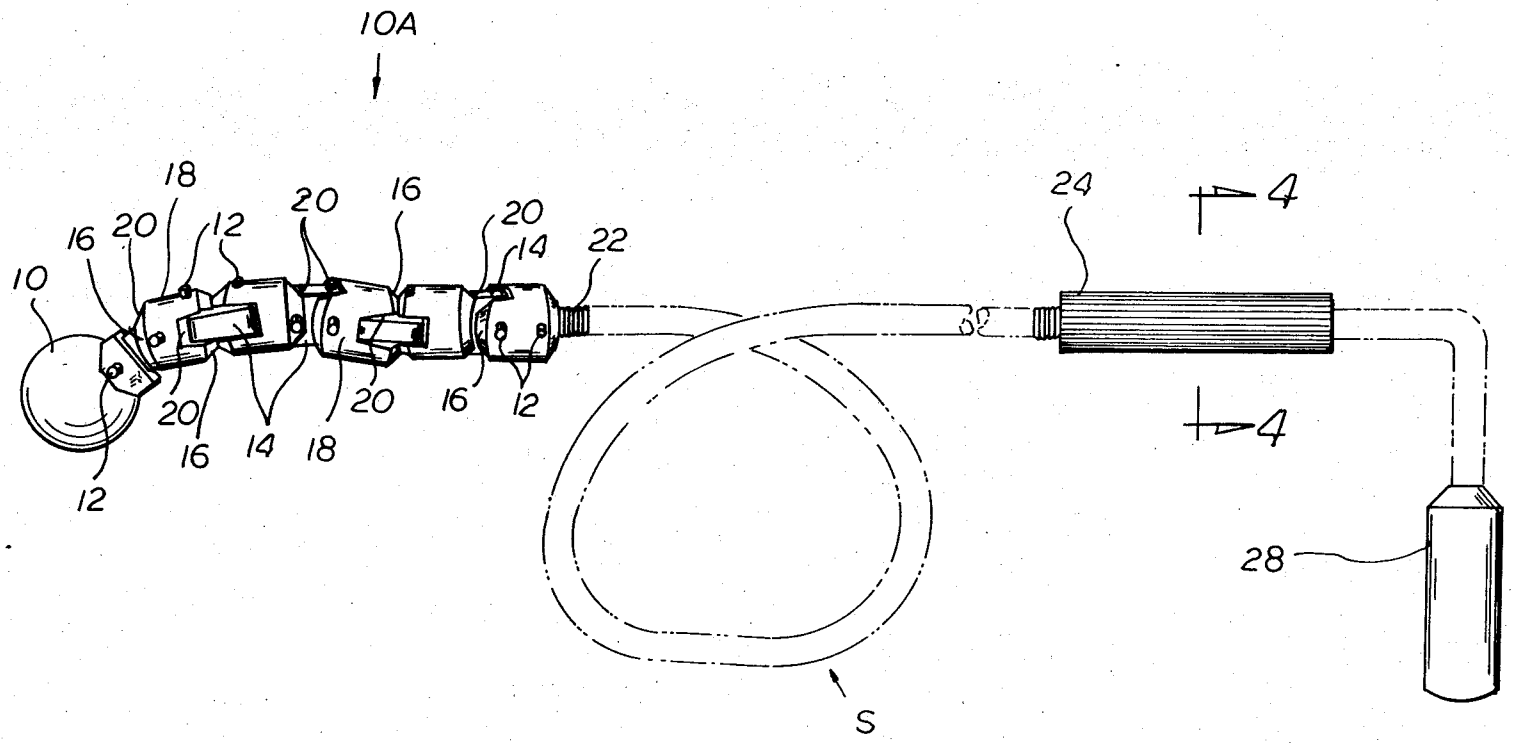
FIG. 1 is a front elevational view of a plumber's snake embodying the invention.
Figure 4:
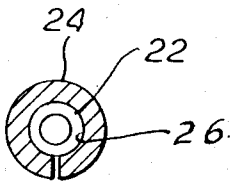
FIG. 4 is a cross section view of a detail of construction taken along line 4—4 on FIG. 1.

One embodiment of the present invention is shown in FIG. 1. FIG. 1 shows a plumber's snake "S" comprising an elongated flexible member 22 having a leading end and a trailing end. A weighted means 10A attached the leading end of member 22. The weighted means 10A includes a weighted ball 10 which is connected to a plurality of jointed members that are composed of a number of links 18, connectors 14, and connecting pins 12. Each link 18 has a transverse slot 20 in each end. The transverse slots 20 in each link 18 are rotated 90 degrees out of phase. Each link 18 also has a bevelled or inclined surface 16 on each end. The connectors 14 are positioned within transverse slots 20 and pinned thereto by pins 12 to serially connect a plurality of links. The transverse slots 20 in links 18 are made large enough so that the connectors 14 can move freely therein about its pin connection. The weighted ball 10 is connected to the end most link, and links 18 and connectors 14 are all pivotally attached by pins 12. The last link 18 furthest from the weighted ball 10 is rigidly attached to shaft or member 22. The flexible member or shaft 22 can be made of any stiff, but flexible material or construction, such as a closely coiled elongated spring or spiral of wire. Shaft or member 22 should be long enough to reach the desired obstruction in the pipe or conduit to be cleared. At the other end of shaft 22 is a handle 28. Handle 28 can be detachably connected to the end of the shaft 22 so that other sections of shaft can be connected together to form a longer shaft, if necessary to reach the obstruction. Disposed on the shaft 22 is a displaceable grip 24. Grip 24 is provided with a bore 26 of a size sufficient to permit grip 24 to slide along the shaft 22. The grip 24 is made of a flexible material that can be squeezed by hand pressure whereby the grip 24 can be frictionally secured to the shaft 22. In the illustrated embodiment the grip 24 comprises a longitudinally split sleeve which circumscribes the shaft. If desired the internal bore 26 may be provided with internal convolutions to complement the coiled shaft 22 for enhancing the gripping force of the grip 24 to the shaft 22 when the grip 24 is squeezed.

In operation or use of the described snake construction, the ball 10 is placed within the accessible end of the pipe or conduit having the obstruction. Shaft 22, in conjunction with grip 24, is then used to manipulate ball 10, connectors 14, and links 18 upon the pipe or conduit. Grip 24 is free to readily slide along the shaft 22 in order to help feed the shaft 22 into the pipe or conduit. When force is needed to advance the snake along a pipe or conduit so as to feed the length of shaft 22 into the pipe or conduit, pressure is applied to squeeze the grip 24 and thereby lock the grip 24 onto the snake or shaft 22. The squeezing of the grip 24 will prevent the grip 24 from slipping along shaft 22, and provides a mechanical advantage whereby the worker or operator can more readily force the snake along a conduit.

After the operator has advanced a length of snake into a pipe or conduit, pressure on the grip 24 is released, and the grip 24 is shifted or moved longitudinally of the shaft 22 a sufficient distance so that another length can be readily advanced into the pipe as hereinbefore described. Thus, the grip 24 functions as an aid which provides the worker with a hand hold by which an operator can apply a greater longitudinal force vector to the snake or shaft 22 to advance it through the pipe to reach any obstruction, and whereby a greater ramming force can be created. The grip 24 may comprise a length of a rubber sleeve which is longitudinally split to permit it to be fitted to the snake or shaft 22, and whereby when squeezed, the grip 24 will frictionally lock onto the snake or shaft as long as the squeezing pressure is maintained.

As the plumber snake S is thus worked and/or incrementally advanced along the length of a pipe or conduit, the links 18 and connectors 14 cause the ball 10 to follow any approaching binds in the conduit. A wandering action is caused by the out of phase relationship of the transverse slots 20. When a sharp bend in the pipe or conduit is encountered the ball will be forced down the newly confronted path. The connectors 14 and links 18 will follow ball 10 as the shaft 22 is forced into the pipe or conduit. The connectors 14 and links 18 can also be worked by manipulation of the shaft 22 to direct the connectors 14 and 18 around the bend. Once the connectors 14 and links 18 have gone around the bend, the shaft 22 will be guided around the bend as the shaft 22 is forced into the pipe or conduit. In this way many obstructions that were unable to be reached by prior art plumbers' snakes because of sharp bends, can now be economically dislodged. The manner in which the ball 10, links 18 and connectors 14 are linked provides a flexible leading end which permits it to flex sharp bends which are not readily negotiated by conventional snakes.

Figure 2:
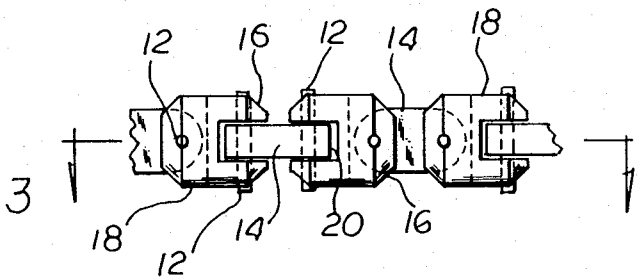
FIG. 2 is a front elevational view of a portion of the invention showing the details of the jointed member end section.

FIG. 2 is a more detailed view of the connector 14 and link 18 assembly shown in FIG. 1, located between ball 10 and shaft 22. Connectors 14 are pivotally attached to links 18 by pins 12. Each connector 14 is oval-shaped permitting the adjacent links 18 to be pivoted toward each other while the plumbers snake is worked down the pipe or conduit. Each link 18 has a bevelled or inclined surface 16 around the circumferential periphery at either end. This bevelled or inclined surface 16 permits the adjacent links 18 to pivot closer toward each other; allowing the plumbers snake to negotiate sharper bends in pipes or conduits. Each link 18 also has a transverse slot 29 in each end. The major axis of each slot is rotated 90 degrees from the major axis of the other slot in each link 18. The slots 20 are sufficiently wide to permit connectors 14 to move freely therein.

Figure 3:
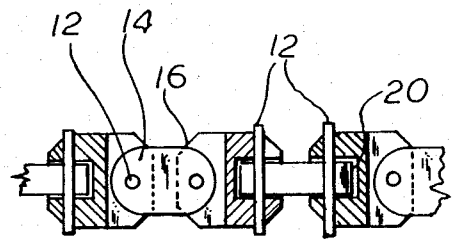
FIG. 3 is a cross section of FIG. 2 along line 3—3.

FIG. 3 is a cross section of the connectors 14 and links 18 assembly shown in FIG. 2 taken along line 3—3 in FIG. 2.

Figure 5:
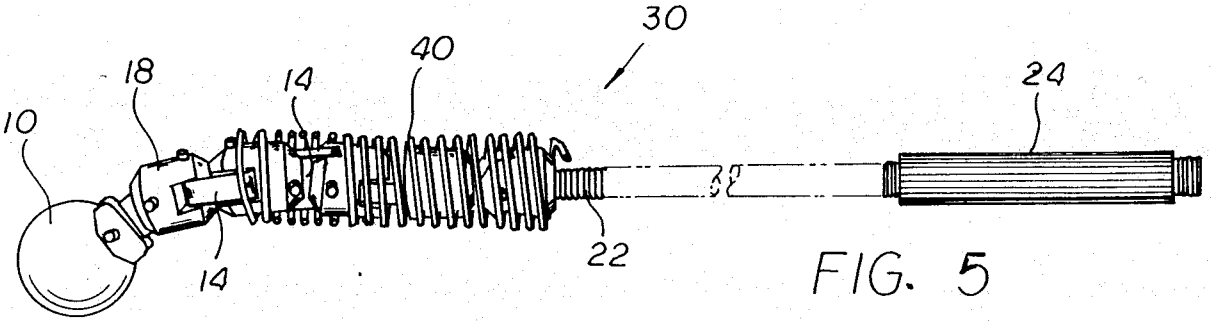
FIG. 5 is a front elevational view of another embodiment of the invention.

FIG. 5 shows another embodiment of the invention. In this form of the invention, a resilient member or spring 40 is coiled over the links 18 and connectors 14 to provide a bias for normally maintaining the links 18 and connectors 14 in a generally straight line. The resilient member or spring 40 can cover some or all of the links 18 and connectors 14. This resilient member or spring 40 helps to control the links 18 and connectors 14 so that they do not bind or bend while in straight sections of large pipes or conduits. Yet, the coil spring 40 is sufficiently resilient so as to follow the pipe bends negotiated by the ball 10, links 18 and connectors 14. In all other respects, the snake 30 of FIG. 5 is similar to that described with respect to FIGS. 1 to 4.

It should be understood that the foregoing disclosure relates to only a preferred embodiment of the invention and that numerous modifications or alterations may be made therein without departing from the spirit and scope of the invention as set forth in the appended claims.

What is claimed is:

1. A plumber's snake comprising:

an elongated flexible member having a leading end and a trailing end, means defining a jointed end portion at the leading end of said flexible member, and a gripping means adjustably disposed along a trailing end of said member, said gripping means comprising a sleeve mounted on said trailing end so as to slide relative thereto, and which, when squeezed, is frictionally secured in fixed relationship relative to said trailing end, wherein said means defining said jointed end comprises:

a plurality of spaced apart links, each of said links having opposed bifurcated end portions to define a slot thereat, wherein said opposed end slots are disposed in out of phase relationship, said links having its end slots disposed in phase relationship to the end slot of the next adjacent link, a connector hingedly connecting the end of one link to the end of the next adjacent link, and a weight member connected to the leading end of the leading link.

2. A plumber's snake as defined in claim 1, wherein said sleeve is longitudinally split whereby it can be readily fitted to a longitudinal portion of said flexible member, said sleeve being formed of a resilient material to frictionally secure to said flexible member when squeezed; and said sleeve having an internal bore configuration complimenting the external configuration of said flexible member so as to form a mechanical engagement between said sleeve and said flexible member when said sleeve is squeezed.

3. A plumber's snake as defined in claim 1 and including a means circumscribing said jointed end portion for maintaining said jointed end longitudinally relative to said extended flexible member, and said circumscribing means being sufficiently flexible to permit said jointed end to negotiate a bend.

4. A plumber's snake comprising:

an elongated flexible member having a leading end portion and a trailing end portion, means defining a jointed end portion connected to the leading end portion of said flexible member, a handle connected to the trailing end portion of said flexible member, said means defining said jointed end including a plurality of spaced apart links, each of said links having opposed bifurcated end portion to define a slot thereat, wherein the opposed end slot of each said link is in an out of phase relationship, said links having its end slots disposed in phase relationship to the end slot of the next adjacent link, a connector having width adapted to be received within the end slot of said adjacent links, means for hingedly connecting said connector to each of said adjacent links within the adjacent end slots of said adjacent links, whereby the successive connectors are disposed in an out of phase relationship, and a weighted member being pivotally connected to the endmost link.

* * * * *